US012716261B1

(12) United States Patent
Goedecke

(10) Patent No.: US 12,716,261 B1
(45) Date of Patent: Aug. 25, 2026

(54) FENCE AND RAILING SYSTEMS AND CONNECTOR ASSEMBLIES THEREFOR

(71) Applicant: Bullet Fence Systems, LLC, Okmulgee, OK (US)

(72) Inventor: Ronald D. Goedecke, Okmulgee, OK (US)

(73) Assignee: Bullet Fence Systems, LLC, Okmulgee, OK (US)

( * ) Notice: Subject to any disclaimer, the term of this patent is extended or adjusted under 35 U.S.C. 154(b) by 0 days.

(21) Appl. No.: 19/553,730

(22) Filed: Mar. 2, 2026

Related U.S. Application Data

(62) Division of application No. 19/009,624, filed on Jan. 3, 2025.

(51) Int. Cl.
*E04H 17/14* (2006.01)

(52) U.S. Cl.
CPC ..... *E04H 17/1473* (2021.01)

(58) Field of Classification Search
CPC ..... E04H 17/143; E04H 17/1473; E04H 17/1417; E04H 17/1447; E04H 17/1448; E04H 17/1452; F16B 2/08
See application file for complete search history.

(56) References Cited

U.S. PATENT DOCUMENTS 1,310,380 A 7/1919 Whittingham
1,822,389 A * 9/1931 Blakely ..... F16B 7/048 248/62
2,150,291 A 3/1939 Paque
2,764,438 A 9/1956 Haviland
2,836,397 A 5/1958 Joseph
3,092,407 A 6/1963 Blonder
3,285,576 A 11/1966 Clark
3,898,713 A 8/1975 Nelson
4,078,772 A * 3/1978 Carbone ..... E04H 17/1447 256/65.04
4,208,038 A * 6/1980 Reid ..... E04H 17/1413 256/65.02
4,471,947 A 9/1984 Osborne
4,899,991 A * 2/1990 Brunkan ..... E04H 17/1447 256/65.06
5,297,890 A 3/1994 Commins
5,961,242 A 10/1999 Leone
6,386,519 B1 5/2002 Priefert
6,530,561 B2 3/2003 Larsen et al.
(Continued)

FOREIGN PATENT DOCUMENTS

FR 2896282 7/2007
FR 3142208 5/2024
(Continued)

*Primary Examiner* — Matthew R Mcmahon
(74) *Attorney, Agent, or Firm* — Dennis D. Brown; Brown Patent Law, P.L.L.C.

(57) ABSTRACT

Fence and railing systems, and connector assemblies therefor, for residential, livestock, business, safety, and other applications wherein the fence or railing systems can be installed without welding, allow the use of wooden privacy fence pickets or any other fence filler material, and allow fence panels and railings to be offset from the vertical posts of the system so that the posts do not interfere with or interrupt the fence panel and railing systems, and so that greater flexibility is provided for directional changes and other purposes.

7 Claims, 7 Drawing Sheets

(56) References Cited

U.S. PATENT DOCUMENTS

| | | | | |
|---|---|---|---|---|
| 7,153,064 | B2 * | 12/2006 | Zeilinger | E02B 3/064 114/263 |
| 7,571,897 | B2 | 8/2009 | Heinz | |
| 8,220,781 | B2 * | 7/2012 | Gray | E04H 17/1473 256/65.13 |
| 9,151,074 | B2 * | 10/2015 | Walters | E04H 17/1448 |
| 9,255,396 | B2 * | 2/2016 | Eberhart | F16B 7/0486 |
| 10,422,155 | B2 * | 9/2019 | Goedecke | E04H 17/1417 |
| 10,676,958 | B2 | 6/2020 | Short et al. | |
| 10,760,298 | B2 | 9/2020 | Crandall et al. | |
| 11,578,502 | B2 | 2/2023 | Naylor | |
| 11,598,118 | B2 | 3/2023 | Afshari | |
| 2006/0226406 | A1 | 10/2006 | Vise | |
| 2012/0138758 | A1 * | 6/2012 | Graber | E04H 17/1417 248/221.11 |

FOREIGN PATENT DOCUMENTS

| | | |
|---|---|---|
| GB | 2116597 | 3/1983 |
| GB | 2199601 | 2/1988 |
| GB | 2300435 | 6/1996 |
| GB | 2570912 | 8/2019 |

* cited by examiner

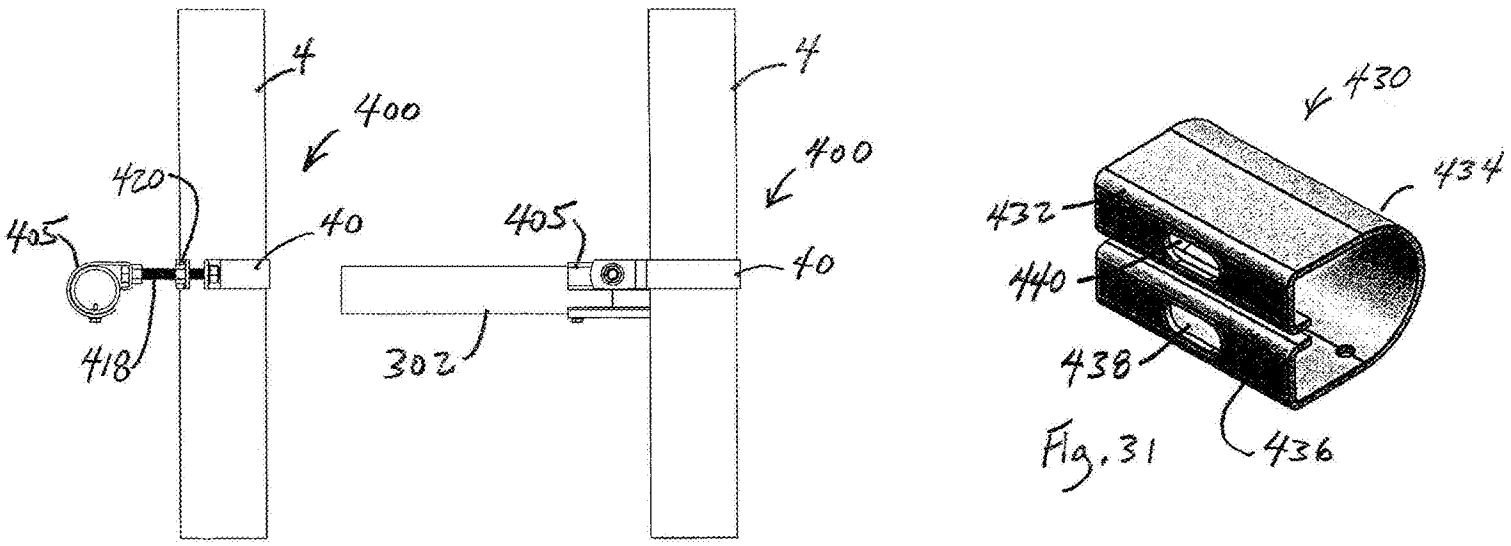
Fig. 31
Fig. 28
Fig. 29
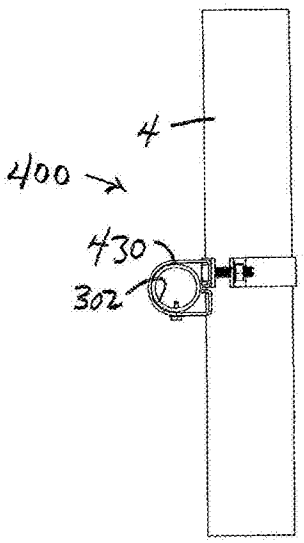
Fig. 32
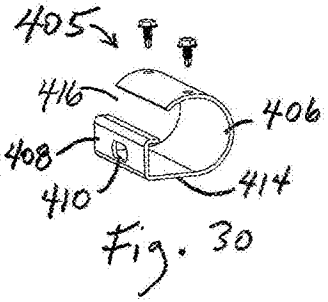
Fig. 30
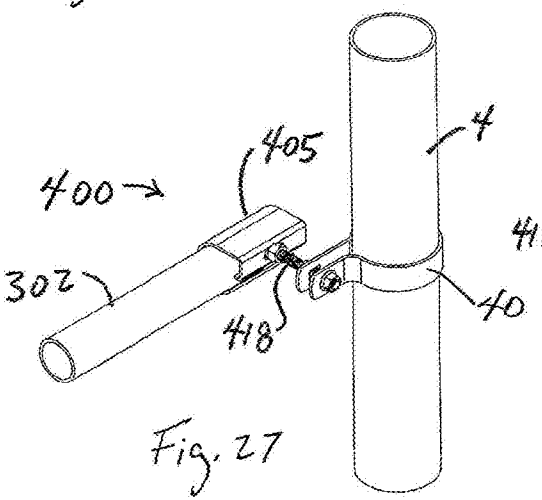
Fig. 27

FENCE AND RAILING SYSTEMS AND CONNECTOR ASSEMBLIES THEREFOR

RELATED CASE

This application is a divisional of pending U.S. patent application Ser. No. 19/009,624 filed Jan. 3, 2025.

FIELD OF THE INVENTION

The present invention relates to fence systems, handrail systems, guardrail systems, and other railing systems, as well as connectors for assembling the fence and railing systems.

BACKGROUND OF THE INVENTION

A need exists for improved fence and railing systems for residences, businesses, farms, ranches, and other uses. A need also exists for improved connector assemblies for constructing and installing fences and railings. The improved fence and railing systems, and the connector assemblies therefor, will preferably be lower cost and easier to install, and will also preferably provide: greater strength and durability; improved weather resistance; a better appearance; new options for the design and appearance of the fence and railing systems; and a greater ability to adapt to the slope of the terrain and to change the direction of the fence or railing system as needed.

SUMMARY OF THE INVENTION

The present invention provides fence and railing systems, and improved connector assemblies therefor, which satisfy the needs mentioned above. The inventive fence systems, railing systems, and connector assemblies: (i) cost less than prior systems and connector assemblies, (ii) are easier and quicker to install, (iii) provide an appearance which is better and/or different than prior fence and railing systems, (iv) readily adapt to the slope of the terrain and to any necessary changes in direction, (v) allow the use of readily available and lower cost post and rail materials, (vi) provide an easy retrofit and upgrade for existing fence and railing systems, (vii) are adaptable for holding wooden pickets or slats, tongue and groove pickets or slats, woven fence or screening materials, welded wire panels, or any other filler materials for the body of a fence, (viii) can be used for residential, livestock, or other applications, and (ix) allow the fence or railing system to be installed without welding.

In one aspect, there is provided an apparatus for a fencing and/or railing system. The apparatus preferably comprises: an upwardly extending post; a rail; and a connector assembly which connects the rail to the post. The connector assembly preferably includes a duck-billed clamping ring which comprises: (i) a semicircular ring in which the post is received, (ii) a first clamping arm which extends from the semicircular ring, is in or substantially parallel to a tangential plane which is tangential to the semicircular ring, and is not spaced apart from the tangential plane by a distance which is more than 20% of a diameter of the semicircular ring, (iii) a second clamping arm which extends from the semicircular ring, is substantially parallel to the first clamping arm, lies in a plane which runs between the first clamping arm and a center point of the semicircular ring, and is not spaced apart from the tangential plane by a distance which is more than 45% of the diameter of the semicircular ring, (iv) a bolt opening extending through the first clamping arm, and (v) a bolt opening extending through the second clamping arm.

In another aspect, there is provided an apparatus for a fencing and/or railing system which preferably comprises: an upwardly extending post; a first rail; a second rail; and a connector assembly which connects an end portion of the first rail and an adjacent end portion of the second rail to the post. The connector assembly preferably includes a first duck-billed clamping ring positioned on the post and a second duck-billed clamping ring positioned on the post on top of the first duck-billed clamping ring. Each of the first and second duck-billed clamping rings preferably comprises a semicircular ring in which the post is received and a clamping bill; wherein, the clamping bill preferably comprises: (i) a first clamping arm which extends from the semicircular ring, is in or substantially parallel to a tangential plane which is tangential to the semicircular ring, and is not spaced apart from the tangential plane by a distance which is more than 20% of a diameter of the semicircular ring, (ii) a second clamping arm which extends from the semicircular ring, is substantially parallel to the first clamping arm, lies in a plane which runs between the first clamping arm and a center point of the semicircular ring, and is not spaced apart from the tangential plane by a distance which is more than 45% of the diameter of the semicircular ring, (iii) a bolt opening extending through the first clamping arm, and (iv) a bolt opening extending through the second clamping arm. The clamping bill of the first duck-billed clamping ring is oriented toward the end portion of the first rail. The clamping bill of the second duck-billed clamping ring is oriented toward the end portion of the second rail.

Further objects, features, and advantages of the present invention will be apparent to those in the art upon reviewing the accompanying drawings and upon reading the following Detailed Description of the Preferred Embodiments.

BRIEF DESCRIPTION OF THE DRAWINGS

FIG. 27 is a perspective view of an alternative embodiment 400 of the rail system provided by the present invention.

FIG. 28 is an elevational side view of the inventive rail system 400.

FIG. 29 is an elevational end view of the inventive rail system 400.

FIG. 30 is a perspective view of a rail attachment holder 405 used in the inventive rail system 400.

FIG. 31 is a perspective view of an alternative rail attachment holder 430.

FIG. 32 illustrates the inventive rail system 400 using the alternative rail attachment holder 430.

DETAILED DESCRIPTION OF THE PREFERRED EMBODIMENTS

Figures 1, 2, 3, 4, 5, 6, 7:
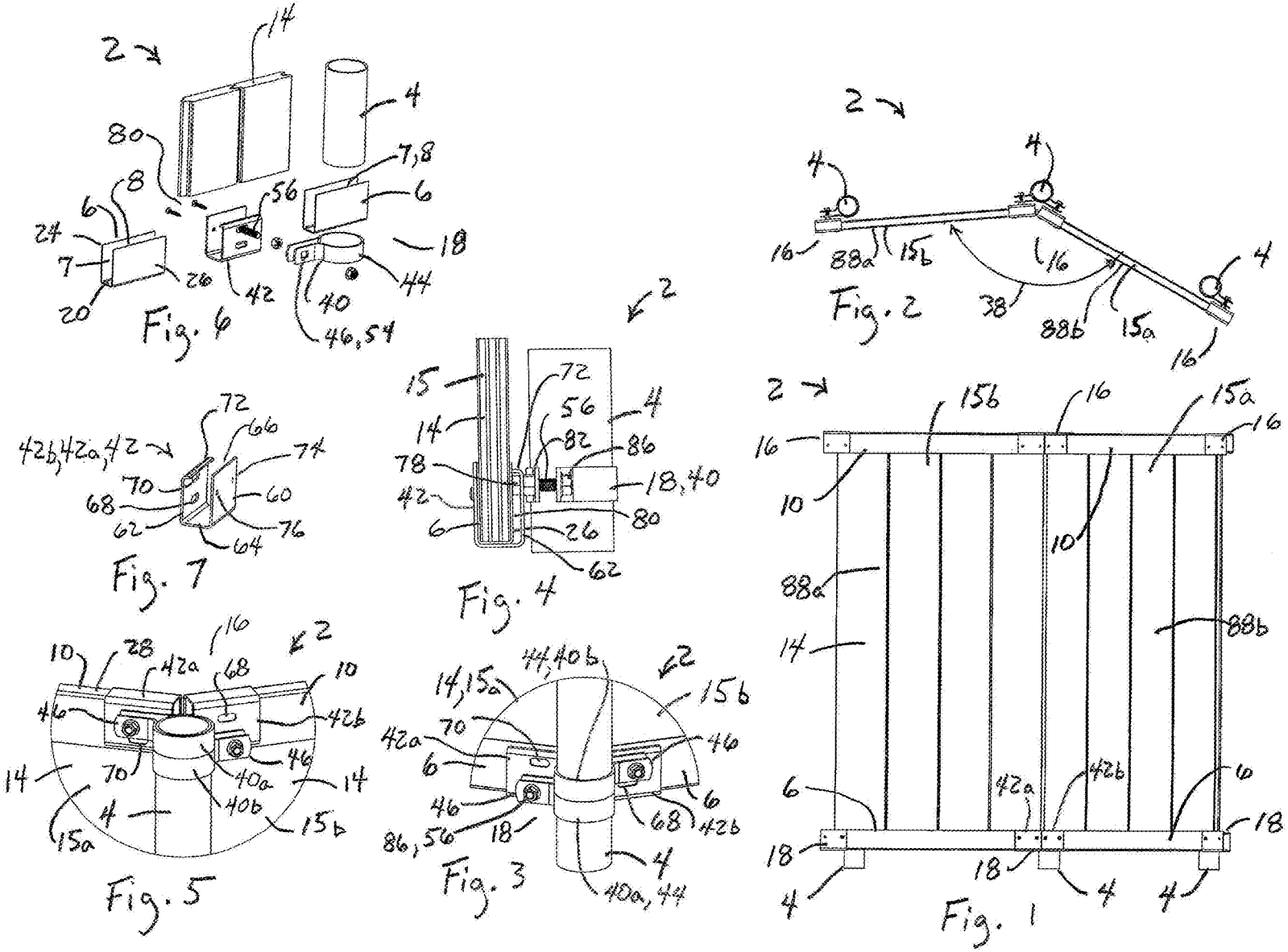
FIG. 1 is an elevational front view of an embodiment 2 of the fence system provided by the present invention.
FIG. 2 is a top view of the inventive fence system 2.
FIG. 3 is a lower sectional back view of the inventive fence system 2.
FIG. 4 is an elevational side view of the inventive fence system 2.
FIG. 5 is an upper sectional back view of the inventive fence system 2.
FIG. 6 is an exploded view of the inventive fence system 2.
FIG. 7 is a perspective view of a fence rail receiver 42 used in the inventive fence system 2.
Figure 9:
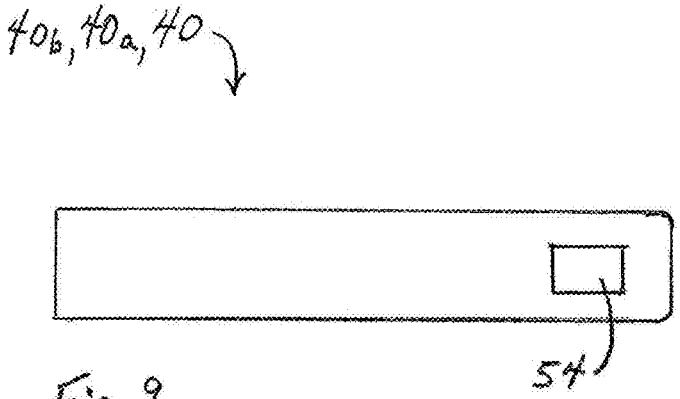
FIG. 9 is an elevational side view of the duck-billed clamping ring 40.
Figure 8:
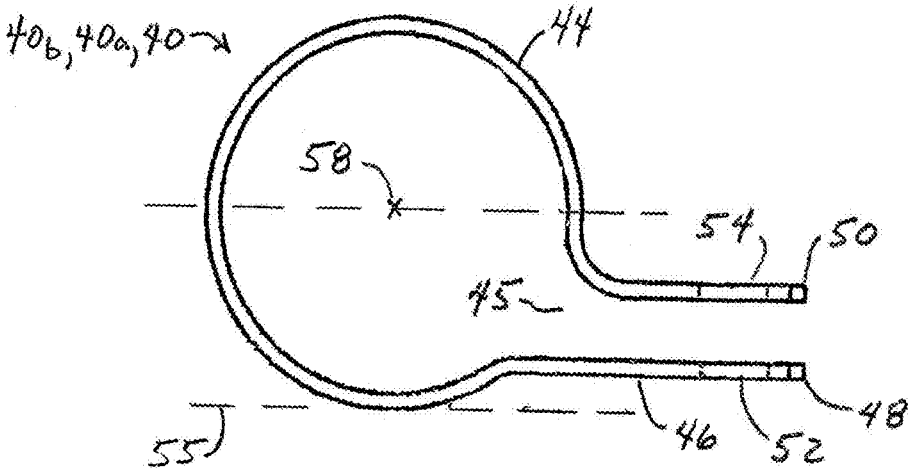
FIG. 8 is a top view of a duck-billed clamping ring 40 used in the inventive fence system 2.
Figure 11:
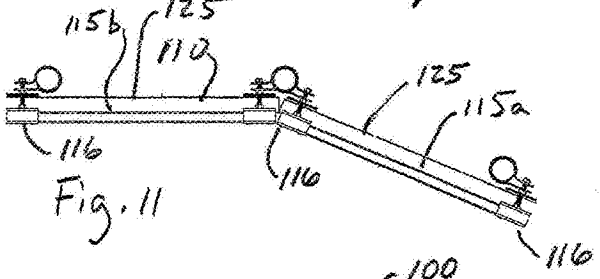
FIG. 11 is a top view of the inventive fence system 100.
Figure 10:
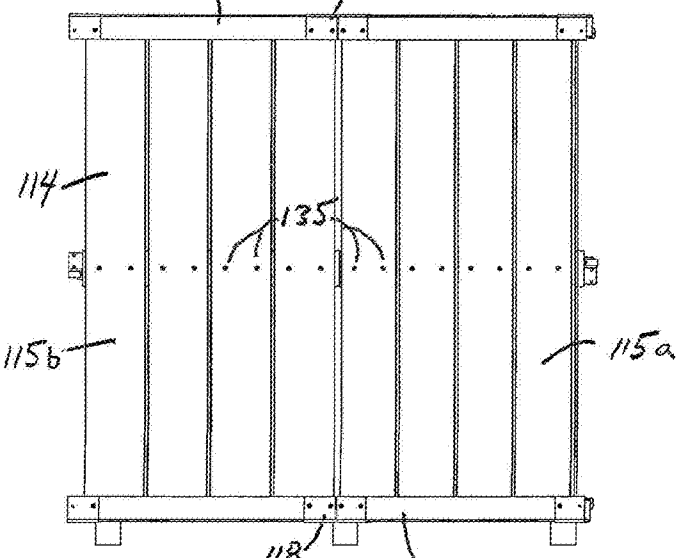
FIG. 10 is an elevational front view of an alternative embodiment 100 of the fence system provided by the present invention.
Figure 12:
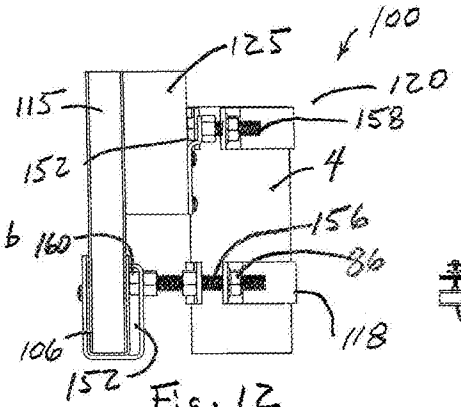
FIG. 12 is an elevational side view of the inventive fence system 100.
Figure 14:
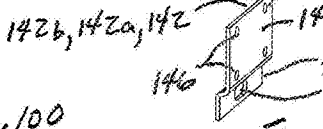
FIG. 14 is a perspective view of an attachment plate 142 used in the inventive fence system 100.
Figure 13:
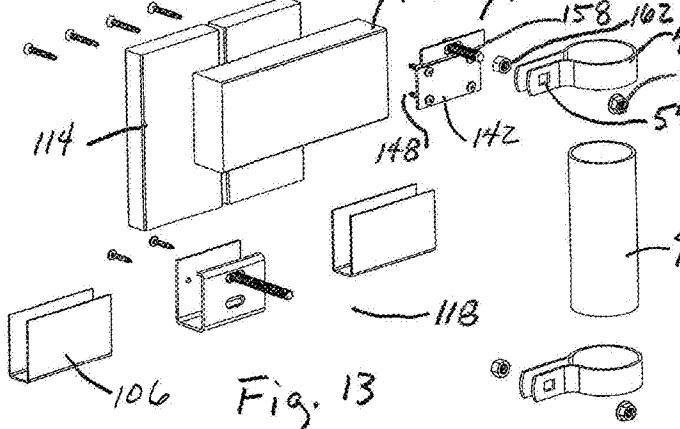
FIG. 13 is an exploded view of the inventive fence system 100.

An embodiment 2 of the inventive fence system is illustrated in FIGS. 1-9. The inventive fence system 2 preferably comprises: (a) a series of vertical fence posts 4 which are preferably cylindrical and (b) one fence panel 15, or a series of adjacent fence panels 15, which is/are attached to the fence posts 4.

Each of the fence panels 15 of the inventive fence system 2 preferably comprises: (i) a horizontally extending bottom fence rail 6 having a longitudinally extending internal channel 7 with an open top 8; (ii) an identical, inverted horizontally extending top fence rail 10 having a longitudinally extending internal channel 7 with an open bottom 8; (iii) a fence filler material (e.g., a series of vertical, wooden or synthetic tongue and groove privacy fence pickets 14 as illustrated in FIGS. 1 and 6) wherein the lower ends of the pickets 14 or other segments of filler material are received in the open channel 7 of the bottom rail 6 and the upper ends of the pickets 14 or other segments of filler material are received in the open channel 7 of the top rail 10; (iv) upper connector assemblies 16 for connecting the top rails 10 of the fence panels 15 to the vertical fence post 4; and (v) lower connector assemblies 18 for connecting the bottom rails 6 of the fence panels 15 to the fence posts 4.

In addition to the tongue and groove fence pickets 14 used in the embodiment 2 of the inventive fence system illustrated in FIGS. 1 and 6, examples of other filler materials 14 which can alternatively be used in the inventive fence system include, but are not limited to, regular wooden or synthetic pickets or slats without tongues and grooves, woven fence or screening materials, and welded wire panels.

The vertical fence posts 4 used in the inventive fence system 2 are preferably formed of segments of cylindrical pipe. In addition, although other materials can alternatively be used, the fence posts 4, the bottom fence rails 6, the top fence rails 10, the upper connector assemblies 16, and the lower connector assemblies 18 will all preferably be formed of metal and will most preferably formed of steel.

The cross-sectional shape of the open channel 7 of the bottom fence rail 6 will preferably be in the form of a U having (i) a flat horizontal bottom wall 20 and (ii) flat, parallel, front and back walls 24 and 26 which extend upwardly from the bottom wall 20. In the same way, the cross-sectional shape of the open channel 7 of the inverted top fence rail 10 will preferably be in the form of an inverted U having (i) a flat horizontal upper wall 28 and (ii) flat, parallel, front and back walls which extend downwardly from the upper wall 28.

It will be understood that, as used herein and in the claims, the term "horizontal" when used in reference to the bottom fence rail 6, the top fence rail 10, or to the inventive fence systems or the features thereof in general, unless otherwise stated, includes both (i) a non-angled, strictly horizontal orientation as well as (ii) a horizontal orientation which is angled to a degree needed to correspond to the slope of the terrain.

In the inventive fence system 2 illustrated in FIGS. 1-9, the upper and lower connector assemblies 16 and 18 are used to connect the adjacent ends of the bottom rails 6 and the top rails 10 of two fence panels 15*a* and 15*b* of the inventive fence system 2 to a fence post 4 at an angle 38 so that the fence 2 is able (although not required) to make a change in direction. Each of the upper and lower connector assemblies 16 and 18 used for connecting the adjacent ends of the bottom rails 6 and the top rails 10 of the two adjacent fence panels 15*a* and 15*b* to the fence post 4 preferably comprise (1) a pair of identical duck-billed clamping rings 40*a* and 40*b* and (2) a pair of identical fence rail receivers 42*a* and 42*b*.

Each of the duck-billed clamping rings 40*a* and 40*b* preferably comprises (i) a semicircular clamping ring 44 which is received around the fence post 4 and (ii) an off-center clamping bill 46 which extends tangentially from the open clamping ring 44.

The clamping bill 46 of each duck-billed clamping ring 40*a* or 40*b* preferably comprises (i) a pair of parallel or substantially parallel clamping arms 48 and 50 which extend from below and above the side opening 45 of the semicircular clamping ring 44 and (ii) bolt holes 52 and 54 which are provided through the clamping arms 48 and 50 for receiving a clamping bolt 56. As used herein and in the claims, the term "substantially parallel" means parallel or up to +20° from parallel.

The clamping arm 48 of the duck-billed clamping ring 40*a* or 40*b* will preferably intersect the clamping ring 44 in a true tangential plane 55 or will be substantially parallel to and spaced apart from the true tangential plane 55 by a distance which is not more than 20% of the diameter of the clamping ring 44. The clamping arm 50 of the duck-billed clamping ring 40*a* or 40*b*, which is parallel or substantially parallel to the clamping arm 48, will also preferably have an off center orientation so that the plane of the clamping arm 50 is between the clamping arm 48 and the center point 58 of the clamping ring 44. The clamping arm 50 will preferably not be spaced from the true tangential plane 55 by a distance which is more than 45% of the diameter of the clamping ring 44.

Each of the fence rail receivers 42*a* and 42*b* used in the upper and lower connector assemblies 16 and 18 preferably comprises: a vertical front wall 60; a vertical back wall 62 which is parallel to and spaced apart from the front wall 60; a horizontal bottom or top end wall 64 which extends laterally between the front wall 60 and the back wall 62; an open bottom or top end 66 which is positioned opposite the horizontal end wall 64; a pair of vertically spaced-apart horizontal slots 68 and 70 which are provided through the vertical back wall 62; a horizontal lip 72 which extends along the distal horizontal edge of the vertical back wall 62 a short distance into the open end 66 of the fence rail receiver 42*a* or 42*b*; and a pair of screw holes 74 and 76 which are provided through the vertical front wall 60.

In order to use the lower connector assembly 18 to connect the adjacent end portions of the bottom fence rails 6 of the adjacent fence panels 15*a* and 15*b* to the fence post 4, the first and second duck-billed clamping rings 40*a* and 40*b* of the lower connector assembly 18 can be placed around the post 4 and positioned near the bottom of the post 4, as illustrated in FIG. 4, such that (i) the clamping bill 46 of the first duck-billed clamping ring 40*a* of the connector assembly 18 points toward the fence panel 15*a* and (ii) the second duck-billed clamping ring 40*b* of the connector assembly 18 is positioned on top of the first clamping ring 40*a* such that the clamping bill 46 of the second clamping ring 40*b* points toward the adjacent panel 15*b*.

Given that the duck-billed clamping ring 40*a* which points toward the fence panel 15*a* is positioned below the second clamping ring 40*b*, the lower connector assembly 18 is used to connect the end portion of the bottom rail 6 of the fence panel 15*a* to the post 4 by: (1) extending a bolt 56 outwardly through the lower horizontal slot 68 of the fence rail receiver 42*a* of the connector assembly 18; (2) placing the fence rail receiver 42*a* on the end portion of the bottom fence rail 6 of the fence panel 15*a* (i.e., the end portion of the bottom rail 6 which is closest to the fence post 4) such that the head 78 of the bolt 56 is positioned in a gap 80, formed by the horizontal lip 72 of the rail receiver 42*a*, between the back wall 26 of the bottom fence rail 6 and the back wall 62 of the fence rail receiver 42*a* (thus preventing the bolt head 78 from interfering with the insertion of the bottom fence rail 6 into the fence rail receiver 42*a*); (3) securing the fence rail receiver 42*a* on the bottom fence rail 6 of the fence panel 15*a* using screws 81 which are threaded through the screw holes 74 and 76 of the fence rail receiver 42*a*; (4) optionally placing a spacing nut 82 on the bolt 56 to provide additional offset spacing, if desired, between the fence rail receiver 42*a* (and thus the fence panel 15*a* itself) and the post 4; (5) extending the bolt 56 through the bolt holes 52 and 54 of the clamping bill 46 of the lower clamping ring 40*a*; and (6) threading a nut 86 onto the end of the bolt 56 to both tighten the duck-billed clamping ring 40*a* on the post 4 and secure the end portion of the bottom rail 6 of the fence panel 15*a* on the fence post 4.

Next, the identical second fence rail receiver 42*b* and the identical second duck-billed clamping ring 40*b* of the lower connector assembly 18 are used to connect the end portion of the bottom rail 6 of the adjacent fence panel 15*b* to the post 4. The procedure for connecting the end portion of the bottom rail 6 of the adjacent fence panel 15*b* to the post 4 is the same as described for fence panel 15*a* above except that, because the second clamping ring 40*b* for the adjacent fence panel 15*b* is positioned on top of the clamping ring 40*a*, the bolt 56 used to connect the fence rail receiver 42*b* for the fence panel 15*b* to the second clamping ring 40*b* must be extended through the upper horizontal slot 70, rather than the lower slot 68, of the second fence rail receiver 42*b*.

It will be understood, however, that the order of stacking and/or the direction of the duck-billed clamping rings 40*a* and 40*b* of the lower connector assembly 16 can be reversed. It will also be understood that rather than using identical fence rail receivers 42*a* and 42*b* which each have both a lower horizontal slot 68 and an upper horizontal slot 70, each of the receivers 42*a* and 42*b* could alternatively have only a single slot wherein, e.g., the single slot of the receiver 42*a* is a lower slot and the slot of the receiver 42*b* is an upper slot. In addition, rather than using bolts 56 which are inserted through horizontal lower and upper slots 68 and 70 of the fence rail receivers 42*a* and 42*b*, it will be understood that the slots 68 and 70 and bolts 56 of the fence rail receivers 42*a* and 42*b* could be replaced, e.g., with (i) a threaded lower bolting rod which is welded to and extends from the receiver 42*a* and (ii) a threaded upper bolting rod which is welded to and extends from the receiver 42*b*.

The components of the upper connector assembly 18 of the inventive fence system 2 will preferably be identical to the components of the lower connector assembly 16. Concerning the use of the upper connector assembly 18 to connect the adjacent end portions of the top fence rails 10 of the adjacent fence panels 15*a* and 15*b* to the fence post 4, the procedure is the same as for the identical lower connector assembly 16 except that the upper connector assembly 18 is essentially inverted. However, as with the lower connector assembly 16, the order of stacking and/or the direction of the duck-billed clamping rings 40*a* and 40*b* of the upper connector assembly 18 can also be reversed.

As one example, as illustrated in FIG. 5, the first and second duck-billed clamping rings 40*a* and 40*b* of the upper connector assembly 16 can be placed around the post 4, and positioned near the top of the post 4, in an order and direction such that (i) the clamping bill 46 of the first duck-billed clamping ring 40*a* of the upper connector assembly 16 still points toward the fence panel 15*a* but (ii) the second duck-billed clamping ring 40*b* of the upper connector assembly 16 is positioned below the first clamping ring 40*a*.

Given that the duck-billed clamping ring 40*a* which points toward the fence panel 15*a* is positioned above the second clamping ring 40*b*, the upper connector assembly 16 is used to connect the end portion of the top rail 6 of the fence panel 15*a* to the post 4 by: (1) extending a bolt 56 outwardly through the horizontal slot 68 of the inverted fence rail receiver 42*a* of the connector assembly 16; (2) placing the inverted fence rail receiver 42*a* on the end portion of the top fence rail 10 of the fence panel 15*a* such that the head 78 of the bolt 56 is positioned in the gap 80, formed by the horizontal lip 72 of the inverted rail receiver 42*a*, between the back wall of the top fence rail 10 and the back wall of the inverted fence rail receiver 42*a* (thus preventing the bolt head 78 from interfering with the insertion of the top fence rail 10 into the inverted fence rail receiver 42*a*); (3) securing the inverted fence rail receiver 42*a* on the top fence rail 6 using screws 81 which are threaded through the screw holes 74 and 76 of the inverted fence rail receiver 42*a*; (4) optionally placing a spacing nut 82 on the bolt 56 to provide additional offset spacing, if desired, between the inverted fence rail receiver 42*a* (and thus the fence panel 15*a* itself) and the post 4; (5) extending the bolt 56 through the bolt holes 52 and 54 of the clamping bill 46 of the clamping ring 40*a*; and (6) threading a nut 86 onto the end of the bolt 56 to both tighten the duck-billed clamping ring 40*a* on the post 4 and secure the end portion of the top rail 10 of the fence panel 15*a* on the fence post 4.

Next, the inverted second fence rail receiver 42*b* and the second duck-billed clamping ring 40*b* of the upper connector assembly 16 are used to connect the end portion of the top rail 6 of the adjacent fence panel 15*b* to the post 4. The procedure for connecting the end portion of the top rail 10 of the adjacent fence panel 15*b* to the post 4 is the same as described for fence panel 15*a* above except that, because the second clamping ring 40*b* for the adjacent fence panel 15*b* is positioned below the clamping ring 40*a*, the bolt 56 used to connect the inverted fence rail receiver 42*b* for the fence panel 15*b* to the second clamping ring 40*b* must be extended through the horizontal slot 70, rather than the slot 68, of the inverted second fence rail receiver 42*b*.

Because of (a) the stacking of the duck-billed clamping rings 40*a* and 40*b* and (b) the corresponding vertical spacing of the horizontal slots 68 and 70 of the fence rail receivers 42*a* and 42*b*, the lower connector assembly 18 and the upper connector assembly 16 are able to connect the bottom and top rails 6 and 10 of the adjacent fence panels 15*a* and 15*b* to the fence post 4 such that (i) the adjacent ends of the bottom rails 6 and the top rails 10 of the fence panels 15*a* and 15*b* are in alignment, (ii) the bottom rails 6 and top rails 10, and the fence panels 15*a* and 15*b* themselves, are outside of, and can be offset a desired distance from, the vertical fence post 4, and (iii) the front side 88*b* of the fence panel 15*b* can be angled with respect to the front side 88*a* of fence panel 15*a*.

In this regard, the use of horizontal slots 68 and 70 in the fence rail receivers 42*a* and 42*b* for bolts 56 helps not only in the alignment of the bolts 56 of the fence rail receivers 42*a* and 42*b* with the bolt holes 52 and 54 of the clamping rings 40*a* and 40*b*, but also helps to ensure that adequate spacing can be maintained between the adjacent ends of the bottom rails 6 and the adjacent ends of the top rails 10 of the fence panels 15*a* and 15*b* to achieve whatever angle 38 between the fence panels 15*a* and 15*b* is desired.

Although the upper and lower connector assemblies 16 and 18 of the inventive fence system 2 are illustrated in FIGS. 3 and 5 as being used for connecting two adjacent fence panels 15*a* and 15*b* to a fence post 4, it will be understood that the upper and lower connector assemblies 16 and 18 can alternatively be used to connect just a single fence panel 15 to the post 4. When using the upper and lower fence connectors 16 and 18 to connect just a single fence panel 15 to a fence post 4, each of the fence connectors 16 and 18 will preferably use only a single duck-billed clamping ring 40 and a single fence rail receiver 42 wherein (i) the single fence rail receiver 42 of the lower connector assembly 18 will be placed on the continuous lower rail 6 of the single fence panel 15 at any point as needed for mating with the single duck-billed clamping ring 40 of the lower assembly 18 and (ii) the single fence rail receiver 42 of the upper connector assembly 16 will preferably be placed on the continuous upper rail 10 of the single fence panel 15 directly above the fence rail receiver 42 of the lower assembly 18.

An alternative embodiment 100 of the inventive fence system is illustrated in FIGS. 10-15. The inventive fence system 100 is the same as the inventive fence system 2 described above except that: (i) the filler material 114 used in the fence panels 115*a* and 115*b* comprises a series of regular, vertical, wooden or synthetic privacy fence pickets, (ii) to provide additional support and strength for the regular pickets 114, each of the fence panels 115*a* and 115*b* also includes a wooden or other horizontal center rail 125 (i.e., a third horizontal rail positioned at a vertical location somewhere (preferably at or near the midpoint) between the lower and upper rails 106 and 110), (iii) the fence pickets 114 are secured to the horizontal center rail 125 using screws 135, and (iv) the bolts 156 of the upper and lower connector assemblies 116 and 118 are longer than the bolts 56 in order to provide a greater offset spacing from the post 4 to accommodate the thickness of the horizontal center rail 125.

The connector assembly 120 used in the fence system 100 to connect the adjacent end portions of the center rails 125 of the fence panels 115*a* and 115*b* to the post 4 is the same as the upper and lower connector assembles 16 and 18 used in the fence system 2 except that the fence rail receivers 42*a* and 42*b* of the connector assemblies 16 and 18 are replaced with a pair of identical attachment plates 142*a* and 142*b*. Each of the attachment plates 142*a* and 142*b* comprises: (i) a first vertical section 144 having holes 146 therethrough for attaching the plate 142*a* or 142*b* to the end portion of a center rail 125 using screws 148, (ii) an offset vertical section 150 which extends from the first vertical section 144 and forms a gap 152 between the center rail 125 and the attachment plate 142*a* or 142*b*, and (iii) a horizontal slot 154 which is provided through the offset vertical section 150 of the attachment plate 142*a* or 142*b*.

Figure 15:
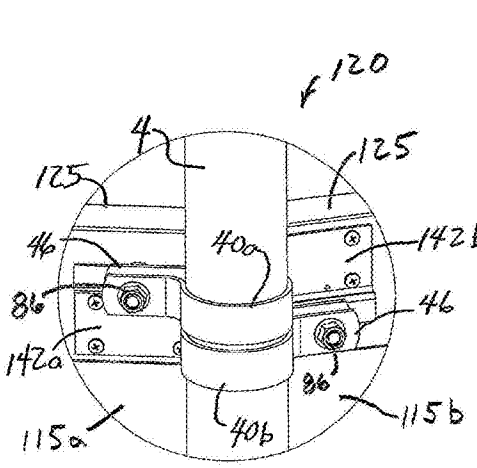
FIG. 15 is a back sectional view of the inventive fence system 100.
Figure 16:
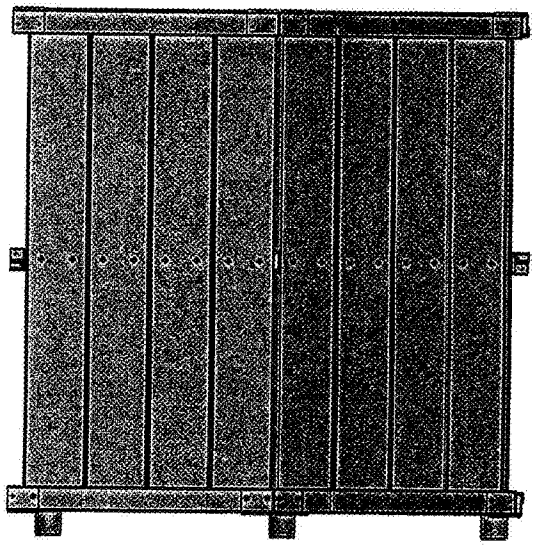
FIG. 16 is a front elevational view of an alternative embodiment 200 of the fence system provided by the present invention.
Figure 17:
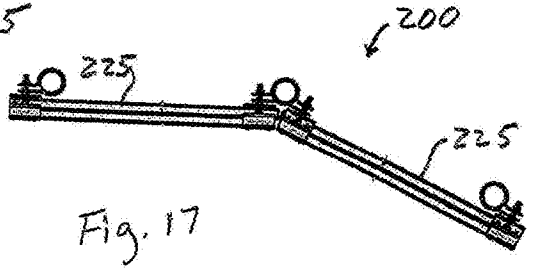
FIG. 17 is a top view of the inventive fence system 200.
Figure 21:
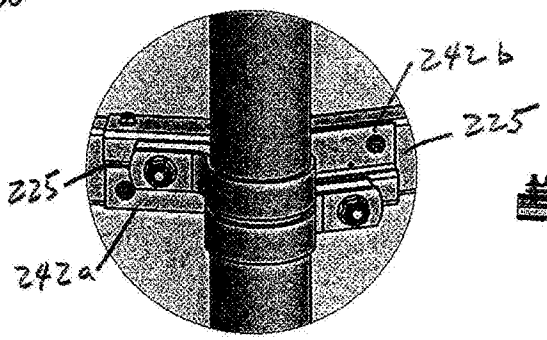
FIG. 21 is a back sectional view of the inventive fence system 200.
Figure 20:
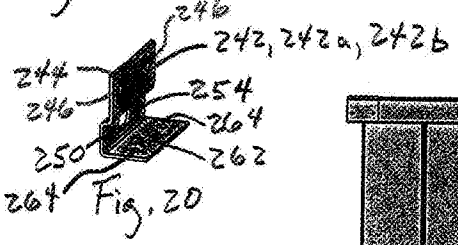
FIG. 20 is a perspective view of a center rail attachment bracket 242 used in the inventive fence system 200.

With the understanding that the vertical positions and/or the directional orientations of the duck-billed clamping rings 40*a* and 40*b* used in the center rail connector assembly 120 can be reversed, an example of one procedure for using the connector assembly 120 to connect the adjacent end portions of the center rails 125 of the fence panels 115*a* and 115*b* to the post 4 would be to place the clamping rings 40*a* and 40*b* around the post 4 near the midpoint of the post 4, as illustrated in FIG. 15, such that (i) the clamping bill 46 of the first duck-billed clamping ring 40*a* of the connector assembly 120 points toward the fence panel 115*a* and (ii) the second duck-billed clamping ring 40*b* of the connector assembly 120 is positioned on top of the first clamping ring 40*a* such that the clamping bill 46 of the second clamping ring 40*b* points toward the adjacent panel 115*b*.

Given that the duck-billed clamping ring 40*a* which points toward the fence panel 115*a* is positioned above the second clamping ring 40*b*, the center rail connector assembly 120 is used to connect the end portion of the center rail 125 of the fence panel 115*a* to the post 4 by: (1) orienting the attachment plate 142*a* such that the offset vertical section 150 thereof is above the first vertical section 144, (2) extending a bolt 158 outwardly through the horizontal slot 154 of the plate 142*a*; (3) attaching the plate 142*a* to the center rail 125 using screws 148 with the head 160 of the bolt 158 positioned in the gap 152 formed by the offset vertical section 150 (thus preventing the bolt head 160 from interfering with the attachment of the plate 142*a*); (4) optionally placing a spacing nut 162 on the bolt 158 to provide additional offset spacing from the post 4; (5) extending the bolt 158 through the bolt holes 52 and 54 of the clamping bill 46 of the lower clamping ring 40*a*; and (6) threading a nut 86 onto the end of the bolt 158 to both tighten the duck-billed clamping ring 40*a* on the post 4 and secure the end portion of the center rail 125 of the fence panel 115*a* on the fence post 4.

Next, the identical attachment plate 142*b* and the identical second duck-billed clamping ring 40*b* of the center rail connector assembly 120 are used to connect the end portion of the center rail 125 of the adjacent fence panel 115*b* to the post 4. The procedure for connecting the end portion of the center rail 125 of the adjacent fence panel 115*b* to the post 4 is the same as described for fence panel 115*a* above except that, because the second clamping ring 40*b* for the adjacent fence panel 115*b* is positioned below the clamping ring 40*a*, the attachment plate 142*b* for the center rail 125 of the fence panel 115*b* will be attached to the end portion of the center rail 125 in an inverted orientation such that the offset vertical section 150 of the attachment plate 142*b* will be below the first vertical section 144.

It will be understood that, rather than using bolts 158 which are inserted through horizontal slots 154 of the attachment plates 142*a* and 142*b*, the slot 154 and bolt 158 of each center rail attachment plate 142*a* or 142*b* could be replaced, e.g., with a threaded bolting rod which is welded to and extends from the attachment plate 142*a* or 142*b*.

Although the center rail connector assembly 120 of the inventive fence system 100 is illustrated in FIG. 15 as being used for connecting the center rails 125 of two adjacent fence panels 115*a* and 115*b* to a fence post 4, it will be understood that the connector assembly 120 can alternatively be used to connect the center rail 125 of just a single fence panel 115 to the post 4. When using the center rail connector assembly 120 to connect the center rail 125 of just a single fence panel 115 to a fence post 4, the connector 120 will preferably use only a single duck-billed clamping ring 40 and a single attachment plate 142, wherein the single attachment plate 142 will be attached to the continuous center rail 125 of the single fence panel 115 at any point as needed for mating with the single duck-billed clamping ring 40.

In addition, it will be further understood that rail(s) 125 of the inventive fence system 100 could alternatively or additionally be top and/or bottom rails of the fence panels 115*a* and 115*b*.

Another alternative embodiment 200 of the inventive fence system is illustrated in FIGS. 16-21. The inventive fence system 200 is the same as the inventive fence 100 except that: (i) the horizontally extending wooden or synthetic center rail 125 of the fence system 100 is replaced with a hollow rectangular, preferably metal, center rail 225 and (ii) the center rail attachment plates 142*a* and 142*b* of the center rail connector assembly 120 of the fence system 100 are replaced with center rail attachment brackets 242*a* and 242*b*.

As with the attachment plates 142*a* and 142*b*, each of the center rail attachment brackets 242*a* and 242*b* of the center rail connector assembly 220 comprises: (a) a first vertical section 244 with holes 246 therethrough for attaching the bracket 242*a* or 242*b* to the vertical back wall 243 of the of the center rail 225 using screws 248; (b) an offset vertical section 250, which forms a gap 252 between the bracket 242*a* or 242*b* and the back wall 243 of the center rail 225 for receiving the head 260 of a clamping ring attachment bolt 258; and (c) a horizontal slot 254 provided through the offset vertical section 250 for extending the clamping ring attachment bolt 258.

Figure 22:
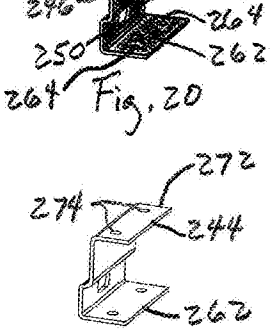
FIG. 22 is a perspective view of an alternative center rail attachment bracket 272.
Figure 18:
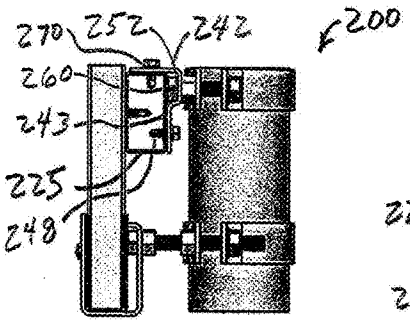
FIG. 18 is an elevational side view of the inventive fence system 200.
Figure 19:
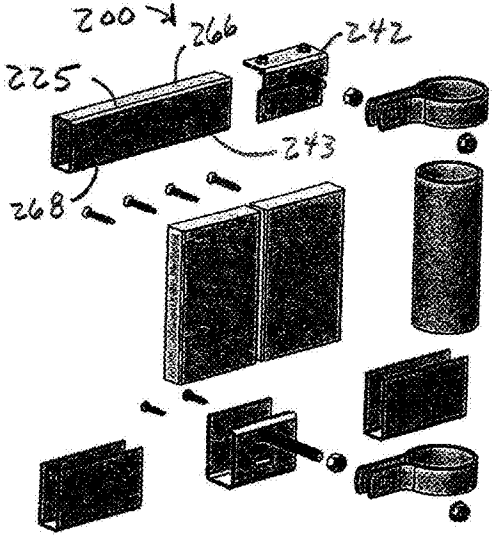
FIG. 19 is an exploded view of the inventive fence system 200.
Figure 25:
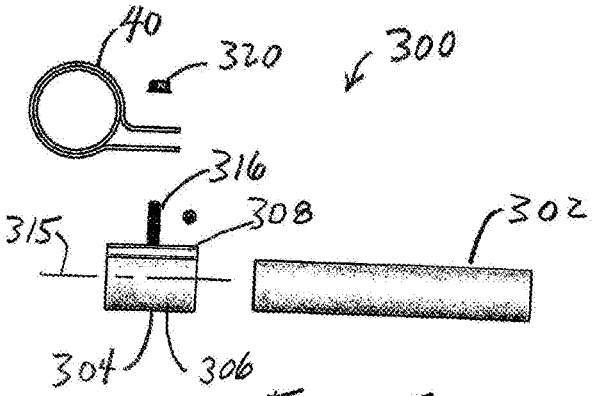
FIG. 25 is an exploded view of the inventive rail system 300.
Figure 23:
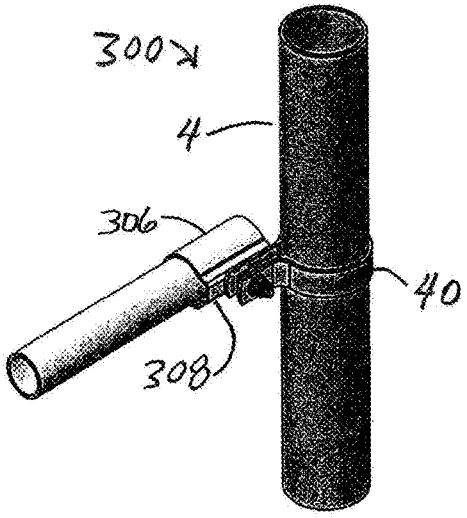
FIG. 23 is a perspective view of an embodiment 300 of the railing system provided by the present invention.
Figure 24:
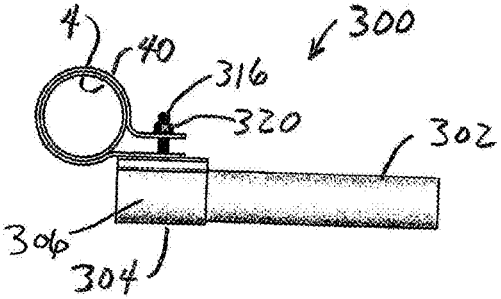
FIG. 24 is a top view of the inventive rail system 300.
Figure 26:
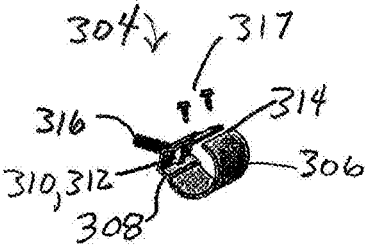
FIG. 26 is a perspective view of a rail attachment holder 304 used in the inventive rail system 300.

In addition, each of the attachment brackets 242*a* and 242*b* also includes a horizontal plate 262 which extends from the distal end of the offset vertical section 250 and has holes 264 therethrough for attachment to one of the horizontal top wall 266 or bottom wall 268 of the center rail 225 using screws 270. Moreover, as illustrated in FIG. 22, the attachment brackets 242*a* and 242*b* could also include a second horizontal plate 272, opposite the horizontal plate 262, which extends from the distal end of the first vertical section 244 and has holes 274 therethrough for attachment to the opposite horizontal top or bottom wall 266 or 268 of the center rail 225 using a pair of screws.

An embodiment 300 of the railing system (e.g., a hand rail, guard rail, safety rail, fence rail, or other horizontal rail) provided by the present invention is illustrated in FIGS. 23-26. The rail system 300 preferably comprises: a vertical post 4; a horizontal rail 302; and a rail connector assembly. The rail connector assembly preferably comprises (i) a duck-billed clamping ring 40, of the same type as described above, which is positioned at a desired height on the post 4 for the horizontal rail 302, and (ii) a rail attachment clamp/holder 304. The horizontal rail 302 used in the rail system 300 is cylindrical and can be formed, e.g., of metal (e.g., steel) or plastic pipe or tubing. However, it will be understood that horizontal rails having square or other cross-sectional shapes and rails formed of other materials can alternatively be used.

The rail attachment clamp 304 of the rail system 300 comprises (i) a rail sleeve 306 in which the end portion of the horizontal rail 302 is received, (ii) a bolting bracket 308 which projects outwardly from the sleeve 306, and (iii) a bolt hole or slot 310 (preferably a horizontal slot) which is provided through the outer vertical wall 312 of the bolting bracket 308. The sleeve 306 will preferably have a cross-sectional shape corresponding to the cross-sectional shape of the horizontal rail 302 and will preferably be an open sleeve having a horizontal break/opening 314. Consequently, for use on a cylindrical rail 302, the sleeve 306 will preferably have a cross-sectional C (semicircular) shape.

In the rail system 300, the bolting bracket 308 is a radial bracket wherein a perpendicular line drawn through the center point of the outer vertical wall 312 of the bolting bracket 308 will intersect, and will be perpendicular to, the longitudinal axis 315 of the sleeve 306.

When attaching the horizontal rail 302 to the post 4, a bolt 316 is extended outwardly (radially) through the horizontal slot 310 of the bolting bracket 308. The rail sleeve 306 is then placed on the end portion of horizontal rail 302 with the head of the bolt 316 being positioned in the bolting bracket 308 so that the head of the bolt 316 does not interfere with the placement of the sleeve 306 on the rail 302. The rail attachment clamp 304 will preferably also be secured on the horizontal rail 302 using screws 317 which are screwed through radial holes provided through the rail sleeve 306. Next, the bolt 316 is extended through the bolt holes 52 and 54 of the duck-billed clamping ring 40 and a nut 320 is tightened on the bolt 310 to both tighten the clamping ring 40 on the post 4 and secure the rail attachment clamp 304 and the horizontal rail 302 to the clamping ring 40.

An alternative embodiment 400 of the inventive railing system is illustrated in FIGS. 27-30. The inventive rail system 400 is the same as the inventive rail system 300 except that the rail attachment holder 304 is replaced with a rail attachment clamp/holder 405. The rail attachment holder 405 comprises: (i) a C-shaped (semicircular) rail sleeve 406 in which the end portion of the horizontal rail 302 is received, (ii) a tangential, off-center, bolting bracket 408 which projects tangentially outward from the sleeve 406, and (iii) a bolt hole or slot 410 (preferably a horizontal slot) which is provided through the outer vertical wall 412 of the tangential bolting bracket 408.

The tangential bolting bracket 408 preferably comprises a horizontal base wall 414 which extends from the rail sleeve 406 and either (i) lies in a true tangential plane 415 for the rail sleeve 406 or (ii) is parallel to the true tangential plane 415 but is not spaced from the true tangential plane by a distance which is more than 20% of the diameter (or width) of the rail sleeve 406. The outer vertical wall 412 of the tangential bolting bracket 408 is preferably perpendicular to, and preferably extends from the distal end of, the base wall 414.

As with the fence systems described above, the tangential bolting bracket 408 of the rail attachment clamp 405 allows two duck-billed clamping rings 40 to be stacked on the post 4 so that the ends of two adjacent horizontal rails 302 can be attached to the post 4, end-to-end, in a co-linear or angled relationship. For the rail 302 attached to the lower duck-billed clamping bracket 40, the rail attachment clamp 405 will be oriented on the rail 302 such that the tangential bolting bracket 408 will be positioned below the longitudinal break/opening 416 in the rail sleeve 406. For the second rail 302 attached to the upper duck-billed clamping bracket 40, the rail attachment clamp 405 will be inverted on the second rail 302 such that the tangential bolting bracket 408 will be positioned above the longitudinal break/opening 416 in the rail sleeve 406.

The bolt 418 used for attaching the rail attachment clamp 405 to the duck-billed clamping bracket 40 can be any length desired, and will preferably utilize a spacing nut 420, to provide (i) any desired offset distance of the rail(s) 302 from the post 4 and (ii) any angle between the adjacent rails 302 which is necessary for changing the direction of the rail system 400. The offset spacing for a handrail also provides room for the hand to pass between the rail 302 and the post 4. In addition, the use of a single attachment bolt 418 facilitates horizontal and vertical angular adjustment of the rail 302.

It will also be understood that if, for example, the cross-sectional shape of the rail 302 is square rather than round, the rail sleeve 406 of the rail attachment clamp 405 will also have a corresponding open square shape and the base wall of the bolting bracket 408 will preferably extend directly, as an extension of, the flat bottom or top wall of the open square rail sleeve 406.

As another alternative, the rail attachment clamp/holder 405 used in the inventive rail system 400 can be replaced with an attachment clamp/holder 430 as illustrated in FIGS. 31 and 32. The attachment holder 430 is the same as the holder 405 except that the clamp 430 includes both (i) an upper tangential, off-center, bolting bracket 432 which projects tangentially outward from the upper curve of a C-shaped rail sleeve 434 and (ii) a lower tangential, off-center, bolting bracket 436 which projects tangentially outward from the lower curve of the C-shaped rail sleeve 434.

As with the rail attachment clamp 405, the rail attachment clamp 430 allows two duck-billed clamping rings 40 to be stacked on the post 4 so that the ends of two adjacent horizontal rails 302 can be attached to the post 4, end-to-end, in a co-linear or angled relationship. However, unlike the clamp 405, it is not necessary to invert the rail attachment clamp 430 when attaching the second rail 302 to the post 4. Rather, the rail attachment clamp 430 can be used such that (a) for attaching a first rail 302 to the lower duck-billed clamping bracket 40, an attachment bolt will be extended through the horizontal slot 438 of the lower tangential bolting bracket 436 of the clamp 430 and (b) for attaching a second rail 302 to the upper duck-billed clamping bracket 40, an attachment bolt will be extended through the horizontal slot 440 of the upper tangential bolting bracket 432 of the clamp 430.

It will be understood that each of the alternative rail systems 300 and 400 provided by the present invention can be used to (i) attach a single rail 302 or a single series of rails 302 to a series of posts 4, (ii) attach two, three, or more parallel rails 302 or series of rails 302 to the posts 4, or (iii) attach chain-link or other fencing materials to the rail systems. The resulting rail systems can be used for hand rails, barriers, livestock fencing, home fencing, and for other purposes.

Figure 35:
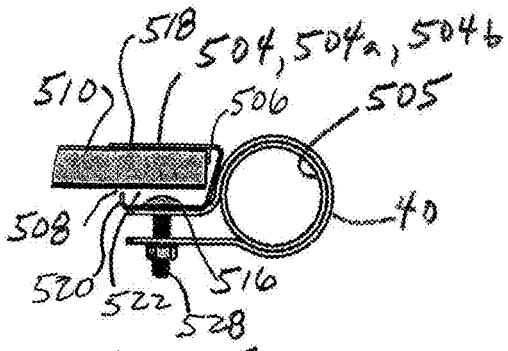
FIG. 35 is an enlarged view of the section 35-35 shown in FIG. 34.
Figure 34:
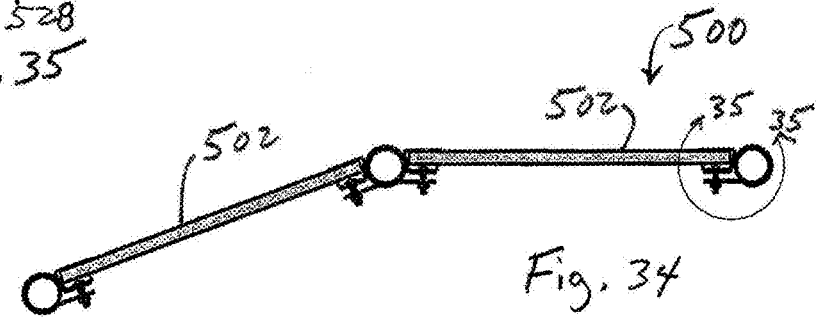
FIG. 34 is a top view of the inventive fence system 500.
Figure 33:
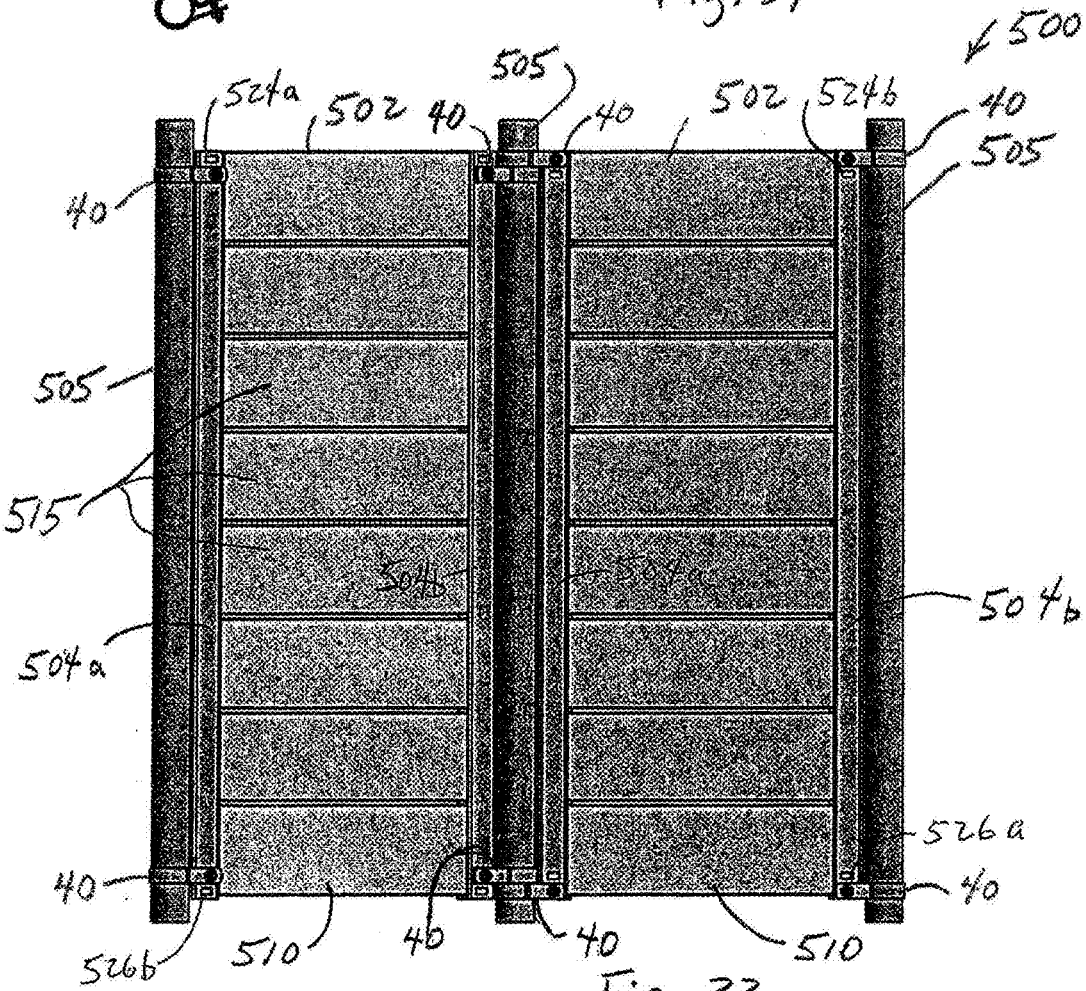
FIG. 33 is an elevational back view of an alternative embodiment 500 of the fence system provided by the present invention.

Another alternative embodiment 500 of the inventive fence system is illustrated in FIGS. 33-35. The fence system 500 comprises fence panels 502 which are attached between fence posts 505 using duck-billed clamping brackets 40 of the same type as described above.

Each of the fence panels 502 comprises: (i) a pair of opposing vertical end rails 504*a* and 504*b* wherein each end rail 504*a* and 504*b* has a vertical internal channel 506 with a vertically extending side opening 508 and (ii) a filler material 510 having a first vertical end portion which is received and retained in the internal channel 506 of the vertical rail 504*a* and an opposite vertical end portion which is received and retained in the internal channel 506 of the vertical rail 504*b*. The filler material 510 can be any type of filler material as mentioned above. In the embodiment 500 shown in FIGS. 33-35, the filler material 510 comprises a vertical series of horizontal wood or synthetic panels or slats 515. The horizontal panels 515 can be, e.g., tongue and groove panels or regular panels without tongues and grooves.

Each of the vertical end rails 504*a* and 504*b* preferably comprises: a vertically extending back wall 516; a vertically extending front wall 518 which is parallel to the back wall 516; a lip 520 which runs vertically along the distal edge of the back wall 516 and extends into the vertical side opening 508 of the internal channel 506; a gap 522 which is formed by the lip 520 in the internal channel 506 between the filler material 510 and the back wall 516; a pair of parallel horizontal slots 524*a* and 524*b* formed through the back wall 516 at the upper end of the vertical rail 504*a* or 504*b*; and a pair of parallel horizontal slots 526*a* and 526*b* formed through the back wall 516 at the lower end of the vertical rail 504*a* or 504*b*.

The vertical end rail 540 (i.e., either 504*a* or 504*b*) of a single fence panel 502 can be attached to a vertical post 505 by: (a) extending a bolt 528 outwardly through one of the horizontal slots 526*a* or 526*b* at the bottom of the end rail 504 such that the head of the bolt 528 will be positioned in the internal gap 522 and will not interfere with the insertion of the vertical end portion of the filler material 510; (b) extending a second bolt 528 outwardly through one of the horizontal slots 524*a* or 524*b* at the top of the end rail 504 in the same manner; (c) inserting the vertical end portion of the filler material 510 into the internal channel 506 of the end rail 504; (d) positioning a lower duck-billed clamping ring 40 around the post 505 at a lower elevation in line with the selected horizontal slot 526*a* or 526*b*; (e) positioning an upper duck-billed clamping ring 40 around the post 505 at an upper elevation in line with the selected horizontal slot 524*a* or 524*b*; (f) extending the first bolt 528 through the bolt holes 52 and 54 of the lower clamping ring 40 and tightening a nut thereon; and (g) extending the second bolt 528 through the bolt holes 52 and 54 of the upper clamping ring 40 and tightening a nut 536 thereon.

On the other hand, if it is desired to attach the vertical side rail 504*a* of a first fence panel 502 on one side of the post 505 and attach the adjacent vertical side rail 504*b* of a second fence panel 502 on the other side of the post 505, each of the adjacent vertical side rails 504*a* and 504*b* will be attached to the post 505 in the same manner as described above for the single fence panel except that: (i) a pair of stacked lower duck-billed clamping rings 40 will be positioned around the lower portion of the post 505; (ii) if the lower clamping ring 40 is at an elevation in line with and is pointed toward the horizontal slot 526*b* of the vertical side rail 504*a* of the first panel 502, then the other clamping ring 40 will be positioned at an elevation which is in line with and will be pointed toward the horizontal slot 526*a* of the adjacent vertical side rail 504*b* of the second panel 502; (iii) a pair of stacked upper duck-billed clamping rings 40 will be positioned around the upper portion of the post 505; and (iv) if the upper clamping ring 40 is at an elevation in line with and is pointed toward the horizontal slot 524*a* of the vertical side rail 504*a* of the first panel 502, then the other clamping ring 40 will be positioned at an elevation which is in line with and will be pointed toward the horizontal slot 524*b* of the adjacent vertical side rail 504*b* of the second panel 502.

Thus, the present invention is well adapted to carry out the objects and attain the ends and advantages mentioned above as well as those inherent therein. While presently preferred embodiments have been described for purposes of this disclosure, numerous changes and modifications will be apparent to those in the art. Such changes and modifications are encompassed within the invention as described herein and as set forth in the claims.

What is claimed is:

1. An apparatus for a fencing and/or railing system comprising:

an upwardly extending post;

a horizontal fence rail at a top or a bottom of a fence panel; and a connector assembly which connects the fence rail to the post, the connector assembly including a clamping ring which comprises a semicircular ring in which the post is received, a first clamping arm which extends from the semicircular ring, a second clamping arm which extends from the semicircular ring and is substantially parallel to the first clamping arm, a bolt opening extending through the first clamping arm, and a bolt opening extending through the second clamping arm, a rail receiver in which the fence rail is received, a threaded member which extends from the rail receiver through the bolt opening of the first clamping arm and the bolt opening of the second clamping arm of the clamping ring, the threaded member being a bolt having a head, and the rail receiver further comprising a front wall having a vertical end, a back wall which is parallel to the front wall and has a vertical end, the back wall having an opening therethrough through which the bolt extends, a horizontal lip which extends from the vertical end of the back wall into an opening between the vertical end of the front wall and the vertical end of the back wall, and the horizontal lip defining an internal gap in the rail receiver, between the back wall of the rail receiver and a back wall of the fence rail, in which the head of the bolt is received.

2. The apparatus of claim 1 further comprising:

the first clamping arm being in or substantially parallel to a tangential plane which is tangential to the semicircular ring, and the first clamping arm not being spaced apart from the tangential plane by a distance which is more than 20% of a diameter of the semicircular ring and the second clamping arm lying in a plane which runs between the first clamping arm and a center point of the semicircular ring, and the second clamping arm not being spaced apart from the tangential plane by a distance which is more than 45% of the diameter of the semicircular ring.

3. The apparatus of claim 1 further comprising:

a first nut positioned on the threaded member between the rail receiver and the first clamping arm of the clamping ring and a second nut tightened on the threaded member outside of the second clamping arm of the clamping ring.

4. An apparatus for a fencing and/or railing system comprising:

an upwardly extending post;

a first horizontal fence rail at a top or a bottom of a first fence panel;

a second horizontal fence rail at a top or a bottom of a second fence panel; and a connector assembly which connects an end portion of the first fence rail and an adjacent end portion of the second fence rail to the post, the connector assembly including a first clamping ring positioned on the post and a second clamping ring positioned on the post on top of the first clamping ring, each of the first and second clamping rings comprising a semicircular ring in which the post is received, a first clamping arm which extends from the semicircular ring, a second clamping arm which extends from the semicircular ring and is substantially parallel to the first clamping arm, a bolt opening extending through the first clamping arm, and a bolt opening extending through the second clamping arm;

the first and the second clamping arms of the first clamping ring being oriented toward the end portion of the first fence rail;

the first and the second clamping arms of the second clamping ring being oriented toward the end portion of the second fence rail;

the connector assembly further comprising a first rail receiver in which the end portion of the first fence rail is received, a second rail receiver in which the end portion of the second fence rail is received, a first threaded member which extends from the first rail receiver through the bolt opening of the first clamping arm and the bolt opening of the second clamping arm of the first clamping ring, and a second threaded member which extends from the second rail receiver through the bolt opening of the first clamping arm and the bolt opening of the second clamping arm of the second clamping ring;

the first threaded member being a first bolt having a head;

the second threaded member being a second bolt having a head;

the first rail receiver further comprising a front wall having a vertical end, a back wall which is parallel to the front wall and has a vertical end, the back wall having an opening therethrough through which the first bolt extends, a horizontal lip which extends from the vertical end of the back wall into an opening between the vertical end of the front wall and the vertical end of the back wall, and the horizontal lip defining an internal gap in the first rail receiver, between the back wall of the first rail receiver and a back wall of the first fence rail, in which the head of the first bolt is received; and the second rail receiver further comprising a front wall having a vertical end, a back wall which is parallel to the front wall of the second rail receiver and has a vertical end, the back wall of the second rail receiver having an opening therethrough through which the second bolt extends, a horizontal lip which extends from the vertical end of the back wall of the second rail receiver into an opening between the vertical end of the front wall of the second rail receiver and the vertical end of the back wall of the second rail receiver, and the horizontal lip of the second rail receiver defining an internal gap in the second rail receiver, between the back wall of the second rail receiver and a back wall of the second fence rail, in which the head of the second bolt is received.

5. The apparatus of claim 4 further comprising for each of the first and the second clamping rings:

the first clamping arm being in or substantially parallel to a tangential plane which is tangential to the semicircular ring, and the first clamping arm not being spaced apart from the tangential plane by a distance which is more than 20% of a diameter of the semicircular ring and the second clamping arm lying in a plane which runs between the first clamping arm and a center point of the semicircular ring, and the second clamping arm not being spaced apart from the tangential plane by a distance which is more than 45% of the diameter of the semicircular ring.

6. The apparatus of claim 4 further comprising:

a first nut positioned on the first threaded member between the first rail receiver and the first clamping arm of the first clamping ring, a second nut tightened on the first threaded member outside of the second clamping arm of the first clamping ring, a third nut positioned on the second threaded member between the second rail receiver and the first clamping arm of the second clamping ring, and a fourth nut tightened on the second threaded member outside of the second clamping arm of the second clamping ring.

7. An apparatus for a fencing and/or railing system comprising:

an upwardly extending post;

a horizontal fence rail at a top or a bottom of a fence panel; and a connector assembly which connects the fence rail to the post, the connector assembly including a clamping ring which comprises a semicircular ring in which the post is received, a first clamping arm which extends from the semicircular ring, a second clamping arm which extends from the semicircular ring and is substantially parallel to the first clamping arm, a bolt opening extending through the first clamping arm, and a bolt opening extending through the second clamping arm, a rail receiver in which the fence rail is received, a threaded member which extends from the rail receiver through the bolt opening of the first clamping arm and the bolt opening of the second clamping arm of the clamping ring, a first nut positioned on the threaded member between the rail receiver and the first clamping arm of the clamping ring, and a second nut tightened on the threaded member outside of the second clamping arm of the clamping ring.

* * * * *